US007314078B2

(12) United States Patent
Melino, Jr. et al.

(10) Patent No.: US 7,314,078 B2
(45) Date of Patent: Jan. 1, 2008

(54) TEMPORARY PARTITION SYSTEM

(76) Inventors: Charles E. Melino, Jr., 490 Wellington Ave., Cranston, RI (US) 02910; Charles E. Melino, Sr., 248 Welfare St., Warwick, RI (US) 02888

( * ) Notice: Subject to any disclaimer, the term of this patent is extended or adjusted under 35 U.S.C. 154(b) by 222 days.

(21) Appl. No.: 10/960,210

(22) Filed: Oct. 7, 2004

(65) Prior Publication Data

US 2005/0077015 A1 Apr. 14, 2005

Related U.S. Application Data

(60) Provisional application No. 60/509,798, filed on Oct. 9, 2003.

(51) Int. Cl.
*E06B 9/56* (2006.01)

(52) U.S. Cl. ..... 160/368.1; 24/516; 248/230

(58) Field of Classification Search ..... 160/330, 160/350, 351, 368.1, 327, 382, 402, 399; 24/504, 516, 540, 541; 248/163.1, 316.2, 248/316.1, 227.3, 228.2, 230.2, 231.31, 172, 248/176, 218.4, 229.13, 230.4; 52/222
See application file for complete search history.

(56) References Cited

U.S. PATENT DOCUMENTS 2,937,842 A * 5/1960 Meek ..... 248/354.5
3,522,658 A * 8/1970 Howell ..... 33/528
4,733,988 A * 3/1988 Kelly ..... 403/373
4,794,974 A * 1/1989 Melino ..... 160/330
5,078,348 A * 1/1992 Babitchenko ..... 248/125.1
5,124,858 A * 6/1992 Goetz ..... 359/872
5,647,102 A * 7/1997 Sterling, Jr. ..... 24/494
5,924,469 A 7/1999 Whittemore ..... 160/368.1
6,152,434 A * 11/2000 Gluck ..... 269/6
6,209,615 B1 4/2001 Whittemore ..... 160/368.1
6,375,138 B1 * 4/2002 Balchan ..... 248/229.21
6,758,449 B1 * 7/2004 Chen et al. ..... 248/146
6,942,004 B2 * 9/2005 Whittemore ..... 160/368.1
6,953,076 B2 * 10/2005 Whittemore ..... 160/368.1
7,073,758 B2 * 7/2006 Whittemore et al. .... 248/218.4

FOREIGN PATENT DOCUMENTS

GB 2 256 134 A 12/1992

* cited by examiner

*Primary Examiner*—David Purol
*Assistant Examiner*—Candace L. Bradford
(74) *Attorney, Agent, or Firm*—Barlow, Josephs & Holmes, Ltd.

(57) ABSTRACT

A novel clamping device for use in conjunction with a temporary partition system is provided. The present invention is a telescoping pole system having a unique clamping end that retains a sheet of plastic or other sheeting material for the establishment of temporary partitions such as the type typically used in connection with dust control. The principal elements of the system include an adjustable, telescoping pole, a clamping end with a mechanism thereon for retaining sheeting material and the sheeting material itself. In conjunction, the elements of the system are installed in the desired location between supporting structure to provide a temporary partition as necessary.

18 Claims, 7 Drawing Sheets

TEMPORARY PARTITION SYSTEM

CROSS-REFERENCE TO RELATED APPLICATIONS

This application is related to and claims priority from earlier filed U.S. Provisional Patent Application No. 60/509,798, filed Oct. 9, 2003, the contents of which is incorporated herein by reference.

BACKGROUND OF THE INVENTION

The present invention relates generally to device for installing temporary partitions into existing construction. More specifically, the present invention relates to a telescoping pole that is adapted to be installed between existing construction elements to receive and support some form of sheeting material to create a temporary partition. The particular focus of the present invention is further directed to the clamping mechanism provided at the end of the telescoping pole for providing support to the sheeting material.

There is often a need to separate or subdivide portions of a building or room for temporary periods of time. For example, if an occupied building is going to be remodeled, the portions of the building that will be under construction must be separated from the portions that will remain occupied in order to control the dust created by the remodeling activities as well as to protect the occupants from the physical construction activity. Generally in these cases, while a permanent type construction method could be effectively utilized, such as the construction of a stud framed wall, this type of construction is relatively costly and results in damage to the surrounding, pre-existing construction to which the wall is fastened. Accordingly, a number of temporary partition systems have been developed. These temporary partitions can be used to serve as a barrier to dust, noise, light, odors, and the like. In construction zones, temporary partitions are useful for protecting a clean area from an adjacent work area, for example, protecting an area where finished building materials such as cabinetry and carpet is stored from an area where plastering and painting is being completed. Often as stated above, even this type of temporary protection is installed using rudimentary techniques for installing partitions. Frequently, temporary partitions made from plastic curtains are simply nailed, screwed or stapled to the floor, ceiling and abutting walls, resulting in damage to these surfaces. In other installations, a curtain is taped or otherwise adhered to the walls and ceilings. In these cases, the tape usually fails to stick, but if it does stick, as the tape is removed, chips of paint are usually pulled off with the tape or an adhesive residue from the tape is left behind.

In an attempt to overcome these drawbacks associated with the rudimentary temporary partitioning techniques, several other systems for constructing partitions have been developed. For example, U.S. Pat. No. 4,794,974 discloses a curtain wall having spring-loaded extendable support legs that support header members which are installed over the legs and held contact with the ceiling by the legs. A curtain is then mounted to the header members with fasteners periodically installed along the length of each header member. In this design however, the support poles, header members, fasteners and curtain are all fairly delicate in construction and require a number of separate parts, increasing manufacturing costs. One particular drawback is that the curtain must be designed to accommodate the fasteners without them tearing out of the material. In addition, installation of this system is awkward and time consuming due to the large number of fasteners that must be installed up near the ceiling to fasten the curtain to the header members.

Other systems provide elaborate devices that are mounted onto the top of a telescoping pole. These systems employ caps with retention member that the sheeting is clamped into before the pole is erected in the desired position. For example, U.S. Pat. Nos. 5,924,469 and 6,209,615 disclose a system that has a flat interface member on the top of a spring loaded pole. The curtain in these cases is fastened to the top of the pole and then trapped between the top of the pole and the ceiling against which the pole is secured. These devices however are difficult to adjust maintain once installed because the pole must removed before adjustments can be made.

There is therefore a need for an improved device and system for erecting temporary partitions that enhances the ease of installation and assembly while further allowing adjustments of the system once installed and easy replacement of the curtain material without necessitating the removal of the entire system.

BRIEF SUMMARY OF THE INVENTION

In this regard, the present invention provides a novel device for use in conjunction with a temporary partition system. The present invention is a telescoping pole system having a unique end that retains a sheet of plastic or other sheeting material for the establishment of temporary partitions such as the type typically used in connection with dust control. The principal elements of the system include an adjustable pole, a clamping end with a mechanism thereon for retaining sheeting material and the sheeting material itself. In conjunction, the elements of the system are installed in the desired location between supporting structural elements as will be described in greater detail below to provide a partition as necessary.

The adjustable pole is simply a tubular system where adjacent sections of tube slide one within the other allowing the overall length of the tube to be adjusted. Some manner of locking device is provided proximate to the area where the two sections of tubing meet to allow the pole to be set to and retained at the desired length. On the bottom end of the pole a foot element is placed having a friction-enhancing element such as a rubber stopper. In addition, a spring element may be included in the adjustable pole to provide pressure that urges the two ends of the pole apart. In this manner, once the pole is placed in a location between a floor and ceiling and is adjusted to the proper length, the pole will exert pressure against the adjacent surfaces to maintain it in the position in which it is installed.

On the top of the pole, a clamping device is installed. The clamping device is placed onto the end of the pole. One end of the clamping device includes a friction-enhancing element such as a rubber stopper, although it may also be a cup or alternately shaped device that is tailored to the specific application. Further, a clamping element is provided that consists of a pivotable clamping member and a cam-lock with an operable handle. The clamping element has a generally flat clamping surface with two protruding sidewalls that extend past either side of the tube. The sidewalls are fastened in a pivotable manner to the tube. In this manner, the flat portion of the clamping element can be pivoted towards and away from the tube element thereby allowing an edge of the sheeting material to be placed into the clamp retained.

The clamping action of the present invention is accomplished by the cam-lock element. As will be discussed in detail below, in one embodiment of the present invention, the cam-lock element is also pivotably mounted between the sidewalls of the clamping element on the opposite side of the tube relative to the clamping surface. The cam-lock device is a circular member mounted eccentrically around a pivot point having a small handle installed therein to allow rotation of the locking device by the user. When the handle is in the upward position, the circular element is rotated where its smaller side faces the tube allowing the clamping surface on the other side of the tube to move away from the tube. When the handle is moved downward, the circle rotates so that its larger side is against the tube drawing the clamping surface against the other side of the tube causing a clamping action. In this manner, a piece of plastic sheeting can be placed into the clamp and retained simply to erect a temporary partition.

In addition, the present invention anticipates that a second clamping device may be installed on the bottom end of the tube to allow the plastic sheeting to be retained both at the top and bottom of the partition system.

Accordingly, it is an object of the present inventions to provide an enhanced temporary partition system that includes a means for supporting the sheeting material in a manner that allows adjustment of the sheeting without removal of the supporting means. It is a further object of the present invention to provide a support device for a temporary partition system that includes an upper clamping member that allows attachment of the sheeting material after the support device is installed in the desired position. It is yet a further objective of the present invention to provide a support device for a temporary partition system that includes a clamping means at the top and bottom ends of the support for retaining both the top and bottom edges of the sheeting material. It is yet another object of the present invention to provide a clamping device that is received on the end of a support pole for further incorporation into a temporary partition system.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
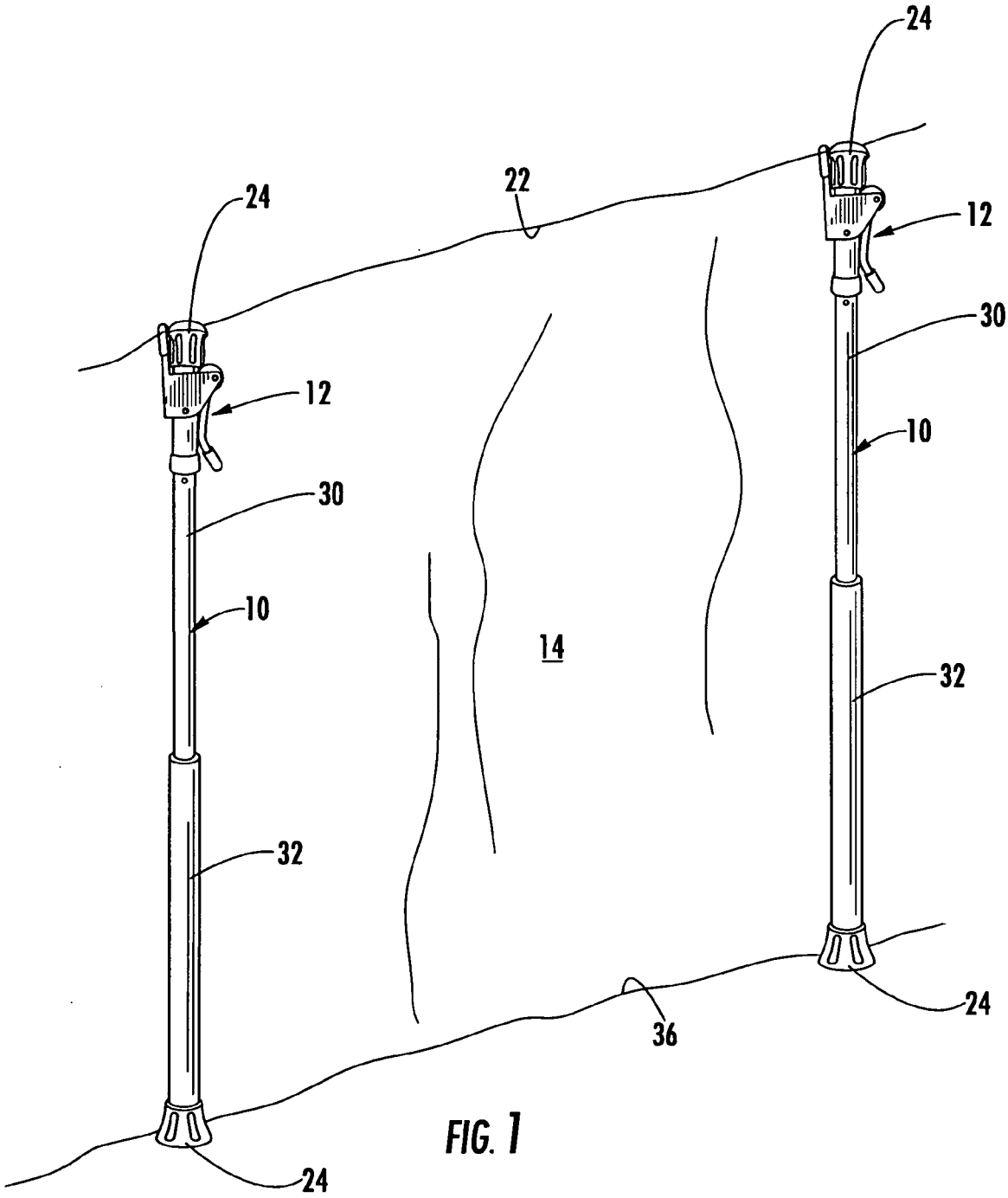
FIG. 1 is a perspective view of a section of the temporary partition system of the present invention.

Now referring to the drawings, the various components of the temporary partition system are shown an illustrated throughout the figures in various contexts. As can be seen the system in general includes an extendable support pole 10, at least one clamping assembly 12 and a sheeting material 14 supported by said clamping assembly 12 in conjunction with said extendable support pole 10.

Turning to FIG. 1, the various components of the temporary partition system are illustrated in their general relationship to one another. It can be seen that the clamping assembly 12 is received onto one end of the extendable support pole 10. One edge of the sheeting material 14 is received and retained by the clamping assembly 12 such that the sheeting material 14 drapes downwardly from the clamping assembly 12 at the top of the extendable support pole 10 adjacent the length of the extendable support pole 10. While at least one extendable support pole 10 could be utilized to support the sheeting material 14 in a tent like enclosure, as is illustrated in FIG. 1, it can be seen that by using at least two extendable support poles 10, the sheeting material 14 extends between the extendable support poles 10 creating a barrier. Further, it should be apparent to one skilled in the art that the addition of a plurality of additional extendable support poles 10 allows the system to be repeated to create a temporary partition that has any length desired by the user or required by the application. It should also be appreciated that the extendable support poles 10 and sheeting material 14 suspended therefrom may be installed in a linear fashion or in any configuration necessary to create the temporary partition system desired. Further, the temporary partition system of the present invention clearly could be installed in a configuration that closes on itself thereby creating an entirely self contained enclosure.

Figure 2:
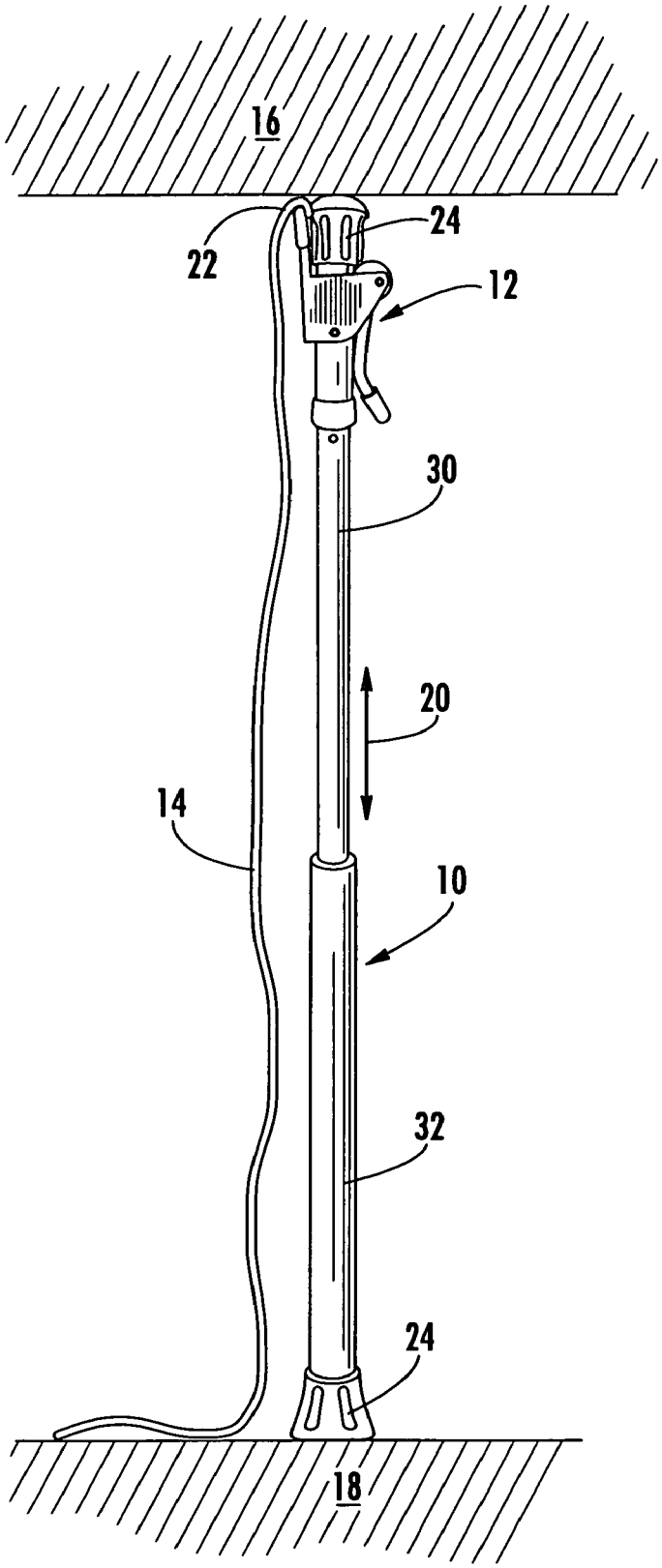
FIG. 2 is a side view of one of the support members of the temporary partition system of the present invention installed between a top and bottom structure with sheeting material installed thereon.

Turning now to FIG. 2, the temporary partition system of the present invention is shown in an installed context relative to an existing structure. A top supporting structure 16 and bottom supporting structure 18 is shown with the extendable support pole 10 and clamping member 12 extending therebetween. As stated above the clamping member 12 is received and retained on one end of the extendable support pole 10 and the extendable support pole 10 is extendable. Accordingly, when placed into its operable position the length of the extendable support pole 10 can be adjusted as is indicated by the arrows 20 shown in the figure to allow the extendable support pole 10 to be placed in firm contact with the top supporting structure 16 and bottom supporting structure 18 thereby retaining the extendable support pole 10 in the desired location and preventing accidental displacement of the extendable support pole 10. Once the extendable support pole 10 is placed in the installed position, the sheeting material 14 can then be installed into the clamping assembly 12 to form the desired partition. It is also possible to clamp the sheeting material 14 into the clamping assembly 12 prior to installation of the extendable support pole 10 in this manner preventing the installer of the partition from needing a ladder to install sheeting material 14 at a later time. The sheeting material 14 can be any type of sheet product that is suitable for the desired application. The sheeting material 14 may be fabric sheeting, any gauge plastic sheeting, canvas or any other appropriate material. As can be seen in this figure, however, one of the desirable aspects of the present invention is that the top edge 22 of the sheeting material 14 is not trapped between the extendable support pole 10 and the adjacent to top supporting structure 16. As a result, the sheeting material 14 can be retensioned or readjusted relative to the extendable support poles 10 without requiring that the extendable support pole 10 be removed from the adjacent top supporting structure 16 and bottom supporting structure 18 first.

The extendable support pole 10 and clamping member 12 are also shown to include rubber stopper ends 24 mounted thereon. The purpose of the stopper ends 24 is to enhance the friction between the surrounding top supporting structure 16 and bottom supporting structure 18 and the extendable support pole 10 itself thereby assisting in preventing the accidental dislodging of a an extendable support pole 10. While the ends are depicted as stopper ends 24, the stopper ends 24 could also be provided as cups, pads, points or clips as required and dictated by the structure to which the extendable support poles 10 will be mounted.

Figure 3:
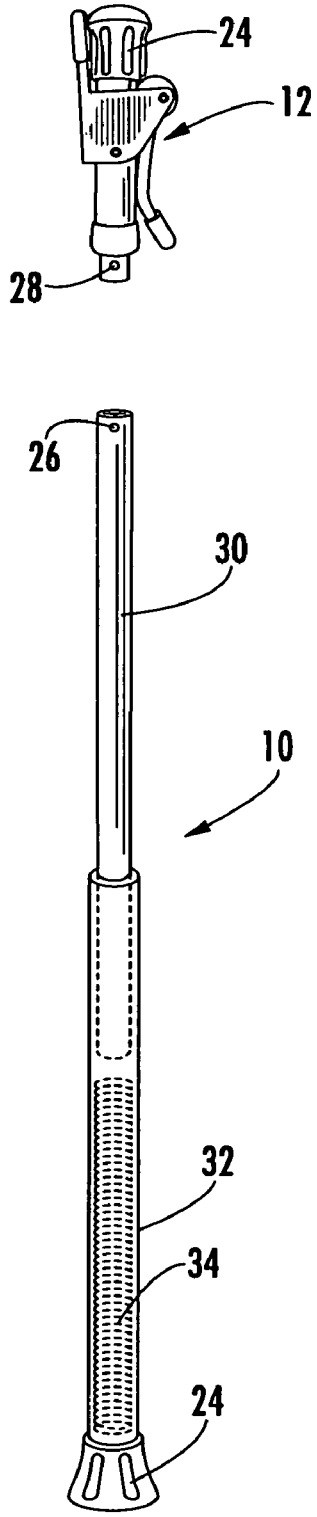
FIG. 3 is an exploded view of one of the support members of the present invention.

Additionally, as is depicted in FIG. 3, the clamping member 12 may be provided as a detachable component relative to the extendable pole member 10. Providing the clamping member 12 as detachable allows the clamping member 12 or the extendable support pole 10 to be reused should one of them become damaged. Also, allowing these elements to be separated from one another facilitates compact storage of the components of the temporary partition system. A detent 26 may be included at the end of the extendable support pole 10 to engage a mating formation 28 on the clamping member 12. The detent 26 and mating formation 28 cooperate to retain the clamping member 12 on the end of the extendable support pole 10 thereby preventing it from being accidentally dislodged.

Further, it can be seen that the extendable support pole 10 may be formed to include a top section 30 and a bottom section 32 and include a spring 34 that urges the top 30 and bottom 32 sections apart from one another by spring biasing the top 30 and bottom 32 sections relative to one another. The purpose of spring biasing the top 30 and bottom 32 members is to facilitate the installation of the extendable support pole 10 between the adjacent top supporting structure 16 and bottom supporting structure 18 and assist in maintaining the extendable support poles 10 in their installed positions. Accordingly, the extendable support poles 10 can be adjusted roughly to the dimension between the top supporting structure 16 and bottom 18 supporting structures while the spring 34 allows for both a tolerance in the length of the extendable support pole 10 and provides a linear force against the adjacent top supporting structure 16 and bottom supporting structure 18 thereby assisting in the retention of the extendable support pole 10.

Figure 4:
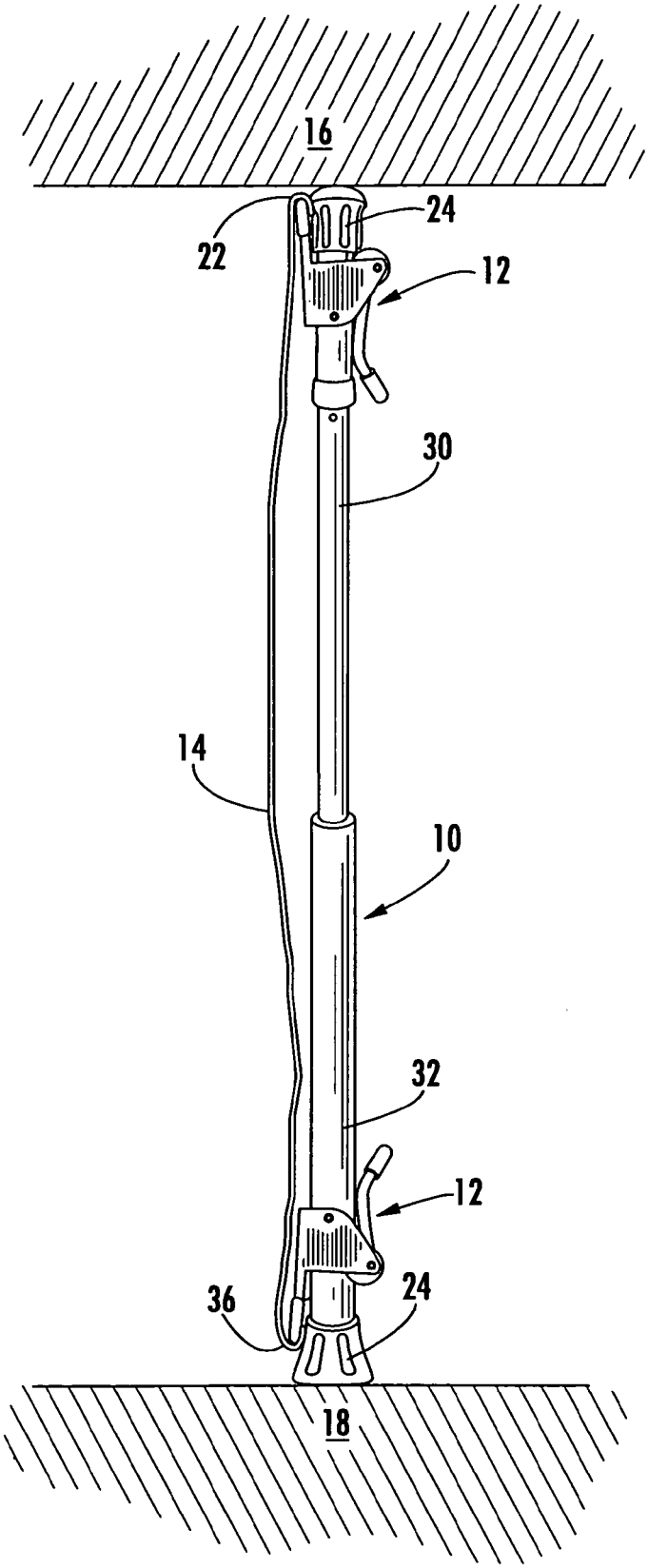
FIG. 4 is a side view of one of the support members of the temporary partition system of the present invention with a top and bottom clamping member installed between a top and bottom structure with sheeting material installed thereon.

Turning to FIG. 4, a temporary partition configuration is shown where a clamping assembly 12 is installed on both the top and bottom ends of the extendable support pole 10. By providing a top and bottom clamping assembly 12, the sheeting material 14 can be retained along both its top 22 and bottom 36 edges. This configuration allows the sheeting material 14 to be stretched taught if desired and prevents the bottom edge 36 of the sheeting material 14 from being displaced relative to the extendable support pole 10.

Figure 5A:
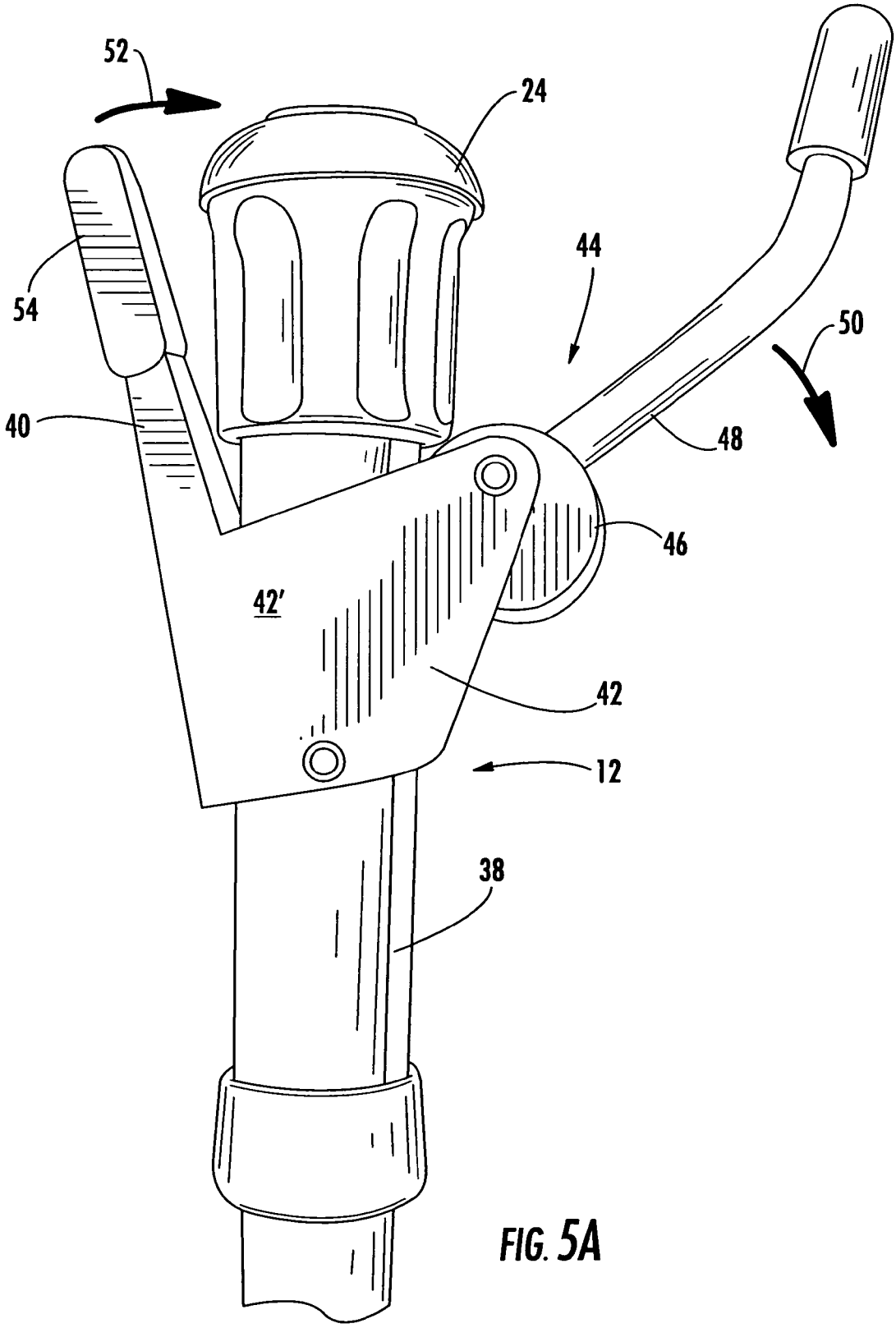
FIG. 5*a* is a side view of a first embodiment of a clamping member in an open position.
Figure 5B:
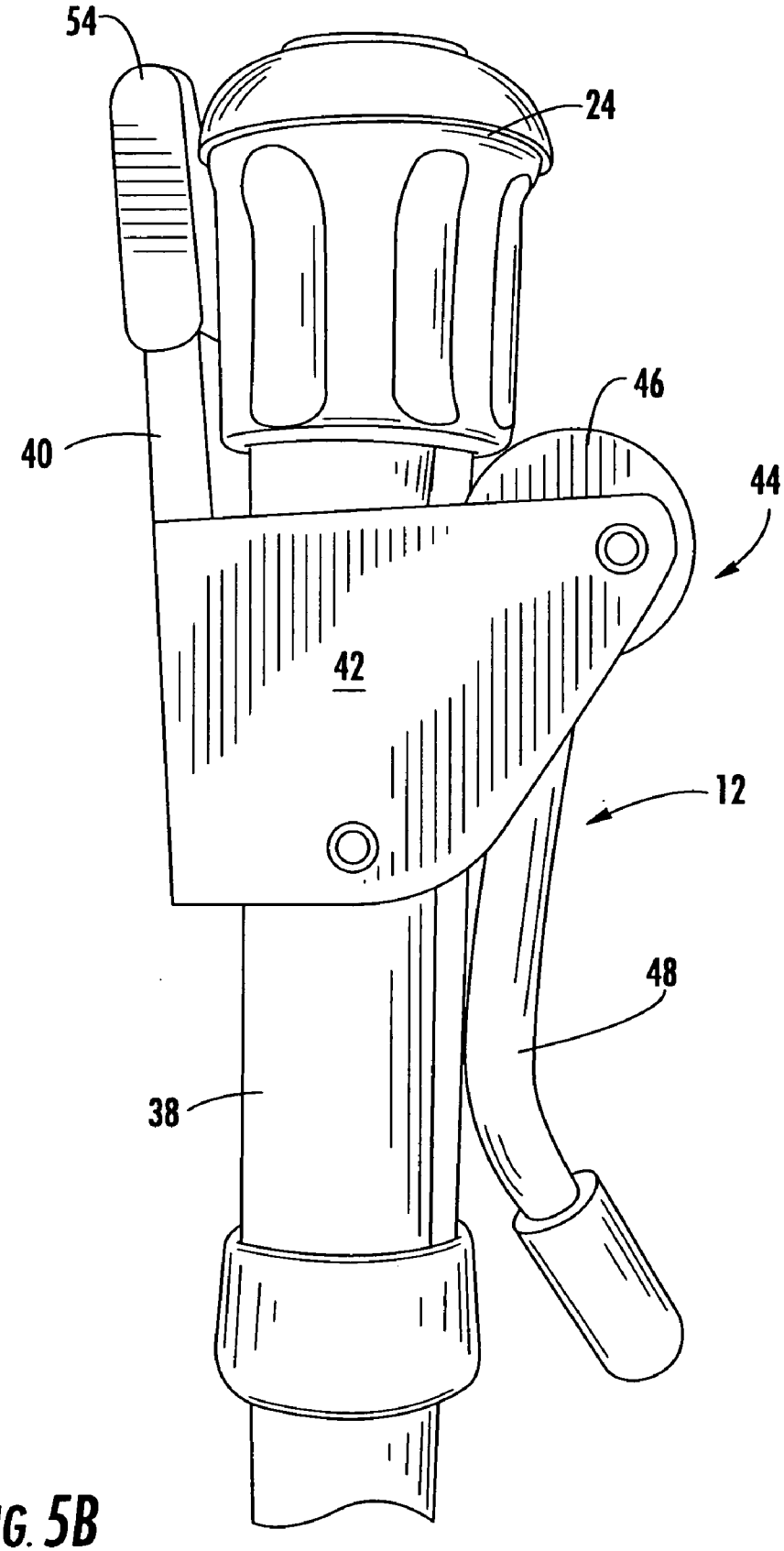
FIG. 5*b* is a side view of a first embodiment of a clamping member in a closed position.

Now turning to FIGS. 5*a* and 5*b*, a first embodiment of a clamping assembly 12 is shown. The clamping assembly 12 includes a body portion 38 that is configured to be received on an end of an extendable support pole 10. A clamping arm 40 is shown that is pivotally mounted to the body portion 38 with a linkage 42 extending from the clamping arm 40 adjacent to and beyond the other side of the body portion 38. An actuator 44 having a cam portion 46 and a handle 48 is shown pivotally attached to the end of the linkage 42 opposite the clamping arm 40. In FIG. 5*a* the clamping arm 40 is shown in an open position with the handle 48 of the actuator 44 rotated in an up position. As can be seen the cam 46 includes an eccentric portion that is pressed against the body 38 of the clamping assembly 12 as the handle of the actuator 44 is displaced downwardly. Rotating the actuator 44 handle 48 downwardly as shown by the arrow 50 causes the cam 46 to press against the body portion 38 thereby pulling the linkage 42 and the clamp arm 40 toward the body 38 of the clamping assembly 12 as illustrated by the arrow 52. As can be seen in FIG. 5*b* once the movement if the actuator 44 handle 48 is complete, the cam 46 retains the linkage 42 in the fully drawn position thereby holding the clamping arm 40 firmly against the body 38 of the clamping assembly 12. When the sheeting material 14 is placed in to the clamping assembly 12 in this manner, the clamping arm 40 firmly retains the edge of the sheeting material 14 in contact with the body 38 of the clamping assembly 12. A friction enhancing member 54 may be provided on the end of the clamping arm 40 to further assist in retaining the sheeting material 14.

Figure 6:
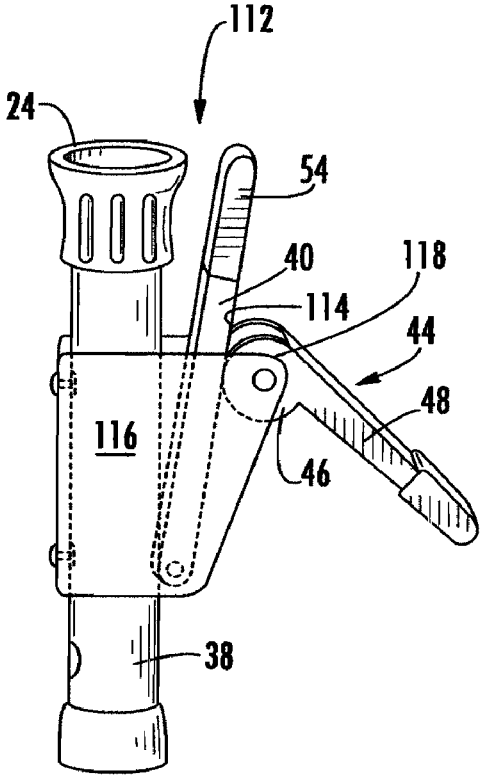
FIG. 6 is a side view of a second embodiment of a clamping member in a closed position.
Figure 7:
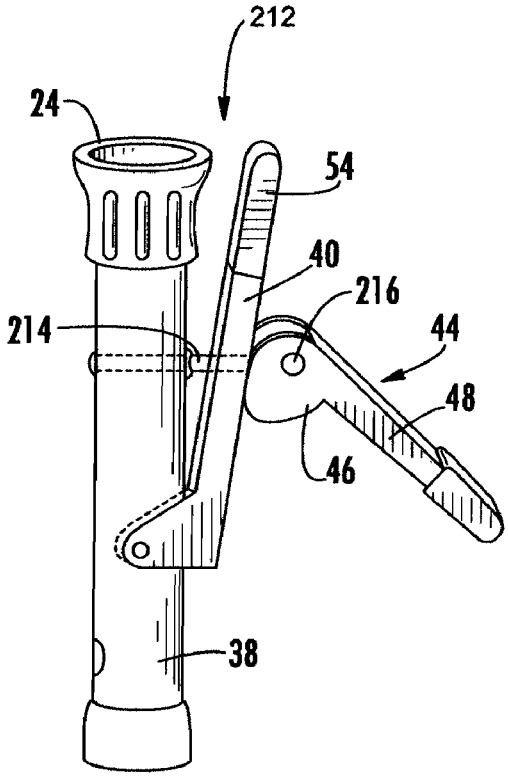
FIG. 7 is a side view of a third embodiment of a clamping member in a closed position.

FIGS. 6 and 7 illustrate to additional embodiments of the clamping assembly. In FIG. 6, the clamping assembly 112 can be seen to include a body portion 38, a clamping arm 40 and an actuator 44 having a cam portion 46 and a handle 48. In this configuration however the actuator 44 is placed adjacent an outer surface 114 of the clamping arm 40 thereby acting directly on the clamping arm 40 itself. Accordingly the need for a linkage between the clamping arm 40 and actuator 44 is eliminated. In place of a linkage, a mounting member 116 extends from the body portion 38 out beyond the clamping arm 40 to provide a free end 118 to which the actuator 44 can be pivotally mounted. In this embodiment, as the actuator 44 is rotated downwardly, the eccentric portion of the cam 46 presses directly on the clamping arm 40 urging it into contact with the body portion 38. In all other respects this embodiment of the clamping assembly 112 functions as described above with regard to FIGS. 5*a* and 5*b*. Finally, in FIG. 7 an embodiment of the clamping assembly 212 is shown that is configured identically to the embodiment in FIG. 6 in all respects except that the mounting member 214 extends from the body portion 38 through a hole in the clamping arm 40 to provide a free end 216 to which the actuator 44 can be pivotally mounted.

It can therefore be seen that the present invention provides a novel system and assembly for creating a temporary partition system that is convenient and offers an assembly that provides several advantages over the prior art. Further, the present invention provides a support system for a temporary partition that allows enhanced adjustability of the system once installed. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A temporary partition system comprising:

at least one extendable support member having a top end and a bottom end said extendable support member configured for placement in a position between top and bottom structural members with its top end in contact with said top structural member and said bottom end in contact with said bottom structural member;

at least one clamping assembly configured to be received and retained on said top end of said extendable support member, said clamping assembly including:

a body portion;

a clamping arm pivotally mounted to said body portion; and an actuator, said actuator including a cam portion and a handle attached to said cam portion, said cam portion of said actuator having a curved camming surface and being pivotally attached to said clamping assembly, wherein movement of said handle causes said cam portion to rotate, said curved camming surface urging said clamping arm from a first open position to a second closed position wherein said clamping arm is retained against said body portion by said actuator; and sheeting material having a top edge and a bottom edge, said top edge being received and retained by said clamping assembly, whereby said sheeting material is supported adjacent said top structural member and extends to said bottom structural member, said sheeting material being repositionable within said clamping assembly without removing said extendable support member from between said top and bottom structural members.

2. The temporary partition system of claim 1, further comprising:

at least two extendable support members each having a clamping assembly on said top ends thereof, said support members being placed in spaced relation to one another in a position between top and bottom structural members with their top ends in contact with said top structural member and said bottom ends in contact with said bottom structural member, said top edge of said sheeting material being received and retained in each of said clamping assemblies whereby said sheeting material extends between and is supported adjacent said top structural member and extends to said bottom structural member.

3. The temporary partition system of claim 1, wherein said temporary sheeting material is selected from the group consisting of: fabric, plastic and canvas.

4. The temporary partition system of claim 1, wherein said extendable support includes a top section, a bottom section and an overall length, wherein said top section and bottom section are configured for interfitting engagement such that said top section and said bottom section can be selectively positioned relative to one another thereby changing said overall length.

5. The temporary partition system of claim 4, wherein said top section and said bottom section of said extendable support are spring biased relative to one another.

6. The temporary partition system of claim 1, wherein said clamping assembly is spring biased relative to said top end of said extendable support member.

7. The temporary partition system of claim 1, further comprising:

a second clamping assembly configured to be received and retained on said bottom end of said extendable support member, said bottom edge of said sheeting material being received and retained by said second clamping member.

8. The temporary partition system of claim 1, further comprising:

a linkage extending from said clamping arm, said clamping arm being pivotally mounted adjacent a first side of said body portion, wherein said linkage extends past said body portion to a second side of said body portion opposite said first side.

wherein said actuator is pivotally attached to said linkage such that rotation of said actuator causes said curved camming surface to exert a force upon said second side of said body portion and said linkage, said linkage thereby urging said clamping arm against said body portion.

9. The temporary partition system of claim 1, wherein said actuator is pivotally attached to said body portion and said clamping arm is disposed between said actuator and said body portion such that rotation of said actuator causes said curved camming surface to exert a force upon an outer face of said clamping arm, thereby urging said clamping arm against said body portion.

10. The temporary partition system of claim 9, further comprising:

at least one mounting member having a first end attached to said body portion and a second end extending beyond said clamping arm, said actuator being pivotally attached to said second end of said mounting member.

11. The temporary partition system of claim 10, wherein said mounting member extends adjacent at least one side of said clamping arm.

12. The temporary partition system of claim 10, wherein said mounting member extends through an opening provided in said clamping arm.

13. A clamping member for use in conjunction with a temporary partition system comprising:

a body portion having a first end configured to be received and retained on an extendable support member;

a clamping arm pivotally mounted to said body portion; and an actuator, said actuator including a cam portion and a handle attached to said cam portion, said cam portion of said actuator having a curved camming surface and pivotally attached to said clamping assembly, wherein movement of said handle causes said cam portion to rotate, said curved camming surface urging said clamping arm from a first open position to a second closed position wherein said clamping arm is retained against said body portion by said actuator.

14. The clamping member of claim 13, further comprising:

a linkage extending from said clamping arm, said clamping arm being pivotally mounted adjacent a first side of said body portion, wherein said linkage extends past said body portion to a second side of said body portion opposite said first side.

wherein said actuator is pivotally attached to said linkage such that rotation of said actuator causes said curved camming surface to exert a force upon said second side of said body portion and said linkage, said linkage thereby urging said clamping arm against said body portion.

15. The clamping member of claim 13, wherein said actuator is pivotally attached to said body portion and said clamping arm is disposed between said actuator and said body portion such that rotation of said actuator causes said curved camming surface to exert a force upon an outer face of said clamping arm, thereby urging said clamping arm against said body portion.

16. The clamping member of claim 15, further comprising:

at least one mounting member having a first end attached to said body portion and a second end extending beyond said clamping arm, said actuator being pivotally attached to said second end of said mounting member.

17. The clamping member of claim 16, wherein said mounting member extends adjacent at least one side of said clamping arm.

18. The clamping member of claim 16, wherein said mounting member extends through an opening provided in said clamping arm.

* * * * *